United States Patent [19]

Spicer

[11] Patent Number: 4,823,658

[45] Date of Patent: Apr. 25, 1989

[54] PUNCH PRESSES

[76] Inventor: Andrew I. Spicer, 15 Arell Street, Brisbane, Queensland 4034, Australia

[21] Appl. No.: 86,044

[22] PCT Filed: Oct. 20, 1986

[86] PCT No.: PCT/AU86/00312

§ 371 Date: Oct. 17, 1985

§ 102(e) Date: Oct. 17, 1985

[87] PCT Pub. No.: WO87/02309

PCT Pub. Date: Apr. 23, 1987

[30] Foreign Application Priority Data

Oct. 18, 1985 [AU] Australia ..... PH2975

[51] Int. Cl.[4] ..... B26D 5/12; F15B 15/08; T15B 21/02

[52] U.S. Cl. ..... 83/74; 83/72; 83/137; 83/527; 83/548; 83/615; 83/617; 83/639; 91/173; 91/189 R; 91/519; 100/269 B

[58] Field of Search ..... 83/72, 74, 137, 527, 83/548, 617, 639, 613, 142, 615; 91/173, 189 R, 519; 92/161; 72/453.05, 453.07; 100/257, 269 R, 269 B, 273

[56] References Cited

U.S. PATENT DOCUMENTS

| | | | |
|---|---|---|---|
| 3,157,070 | 11/1964 | Heidrich | 91/173 |
| 3,563,136 | 2/1971 | Valente | 91/519 |
| 3,602,098 | 8/1971 | Balkee | 91/519 |
| 4,030,391 | 6/1977 | Swanson et al. | 83/137 |
| 4,208,935 | 6/1980 | Kollmar | 83/617 |

*Primary Examiner*—Frank T. Yost
*Assistant Examiner*—Hien H. Phan
*Attorney, Agent, or Firm*—Helfgott & Karas

[57] ABSTRACT

An improved punch assembly (10) for a punch press comprises a main piston (13) driving a punching tool (11) and an auxiliary piston (17) which can be selectively enabled to cooperate with the main pistol (13) in a high force, slow speed mode or disabled to allow the main pistol (13) to operate alone in a low force high speed mode. The punch assembly (10) also comprises a pressure transducer (41) and position transducer (25) whose respective outputs are connected to a microprocessor controller for the punch assembly. Operation of the punch press is microprocessor controlled to reduce noise and punch cycle time. A stripper assembly (42–48) is also provided and operates in conjunction with the punching tool (11) under microprocessor control to facilitate tool stripping. The stripper assembly (42–48) can also be used for automatic measuring of work sheet thickness.

12 Claims, 5 Drawing Sheets

PUNCH PRESSES

FIELD OF THE INVENTION

This invention relates to improvements to punch presses and in particular to an improved punching head assembly for punch presses.

BACKGROUND ART

Commonly punch presses are employed to punch holes in metal sheet and plate and, for this purpose, most punch presses comprise a C-shaped frame having a punch head assembly adapted to reciprocate the punch in a vertical direction to co-operate with a die over which the sheet or plate to be punched is positioned. Many such presses employ crank drive arrangements to cause reciprocation of the punch. However in such arrangements the stroke of the punch cannot be varied easily, for example to cater for varying material thicknesses. Furthermore, the noise generated by such press arrangements during punching is relatively high.

It is also known to drive punching tools by hydraulic means, for example by reciprocating pistons. Whilst in this arrangement the stroke of the punch can be varied, noise generation still remains a problem. Additionally, hydraulic drives are not normally adapted for rapid punching of thin plate as well as for punching thicker plate.

OUTLINE OF THE INVENTION

It is an object of the present invention to overcome or alleviate at least some of the above disadvantages by providing an improved punching head assembly for a punch press which may be readily adapted for punching both thin and thicker plate.

It is another object of the present invention to provide means for controlling the operation of the punching head assembly so as to reduce generated noise levels and/or to optimise punching rate in accordance with the material being punched.

It is yet another object of the present invention to provide an improved stripper assembly to facilitate the stripping of the punch tool from the work sheet.

In one broad form the present invention provides a punching head assembly for a punch press, said punching head assembly comprising a cylinder portion having a first piston member adapted for reciprocating movement therein, said first piston member having a pair of radially inwardly stepped portions each having a radial work surface defining part of a respective one of extend and retract chambers between said piston member and said cylinder portion, said extend and retract chambers being in respective fluid communication with control means adapted to alternate the flow of pressurised fluid to said chambers to obtain reciprocating movement of the piston member; said punching head assembly further comprising a second piston member juxtaposed axially with said first piston member and having a radial work surface defining part of a second extend chamber which is in controlled fluid communication with said control means, whereby the flow of pressurised fluid to said second extend chamber can be selectively opened to drive said first and second piston members together and closed to disable said second piston.

Preferably the work surface of the first extend chamber is greater than the work surface of the second extend chamber.

In a first mode of operation, the fluid communication path between the control means and the second extend chamber is closed so that only the first piston is driven. In this mode of operation the punch can be operated at a high rate at relatively low force. In a second mode of operation, the fluid communication path between the control means and the second extend chamber is opened so that the second piston member is driven via the second extend chamber, and in turn, drives the first piston member. The first piston member is also driven via the first extend chamber at the same time. (The first and second extend chambers may share a common fluid communication path for this purpose). In this mode of operation, a significantly higher punching force is achieved, but at lower speed since a greater volume is required to be filled by hydraulic fluid during each stroke.

Typically, the control means comprises a plurality of microprocessor-controlled servo valves which control the flow of pressurised fluid to the chambers.

Advantageously a displacement transducer and a pressure transducer are provided to enable the microprocessor to monitor the position of the first piston member and the fluid pressure. The microprocessor can then be programmed to minimise noise, for example by slowing down the punch towards the end of its stroke.

A stripper assembly can also be provided to operate in conjunction with the punching tool to facilitate the stripping or removal of the tool from the punch hole.

BRIEF DESCRIPTION OF THE DRAWINGS

In order that the invention may be more readily understood and put into practical effect, reference will now be made to the accompanying drawings which illustrate a preferred embodiment of the invention and wherein.

METHOD OF PERFORMANCE

Figure 1:
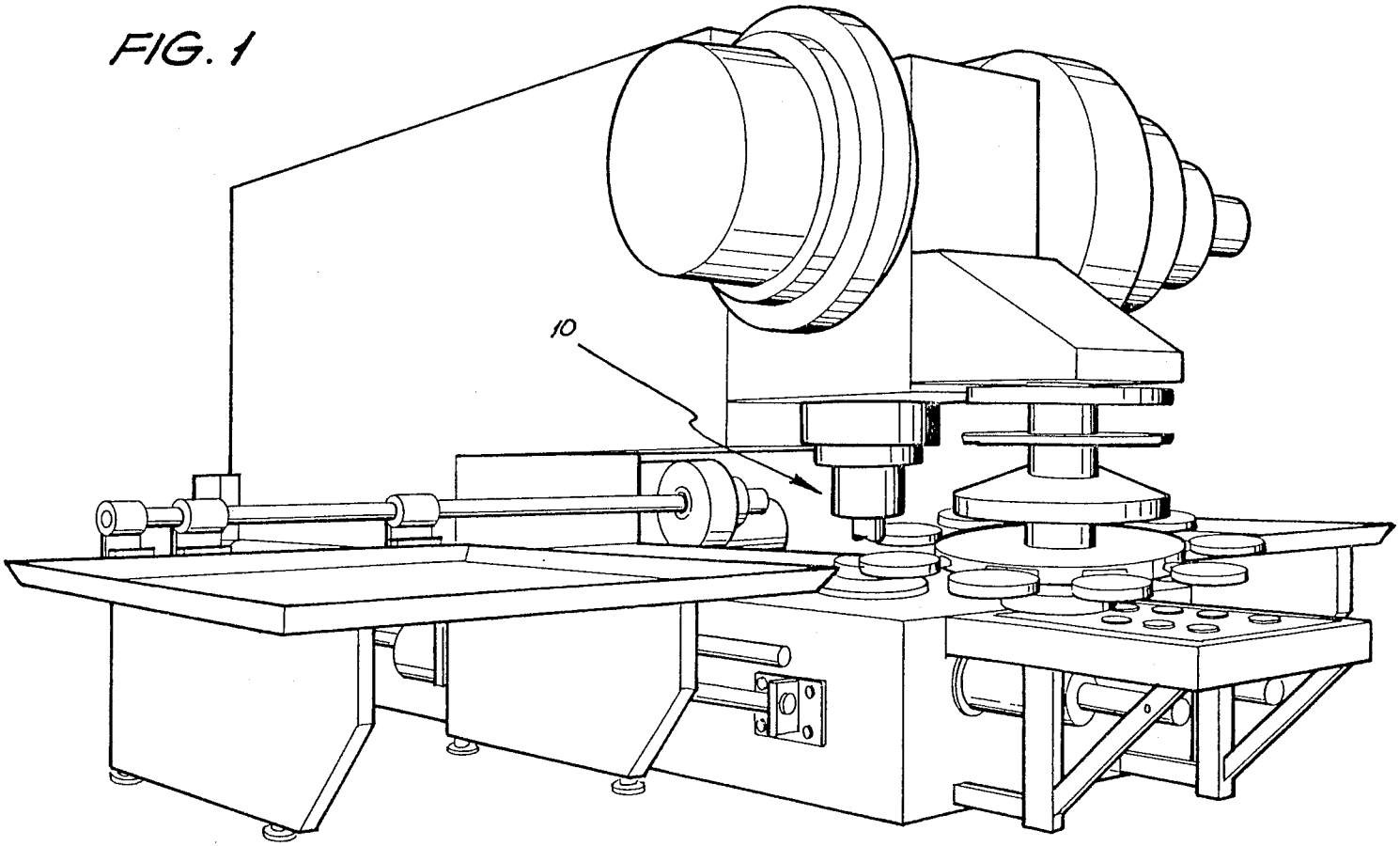
FIG. 1 is a perspective view of a typical punch press using the punching head assembly of of the embodiment.
Figure 2:
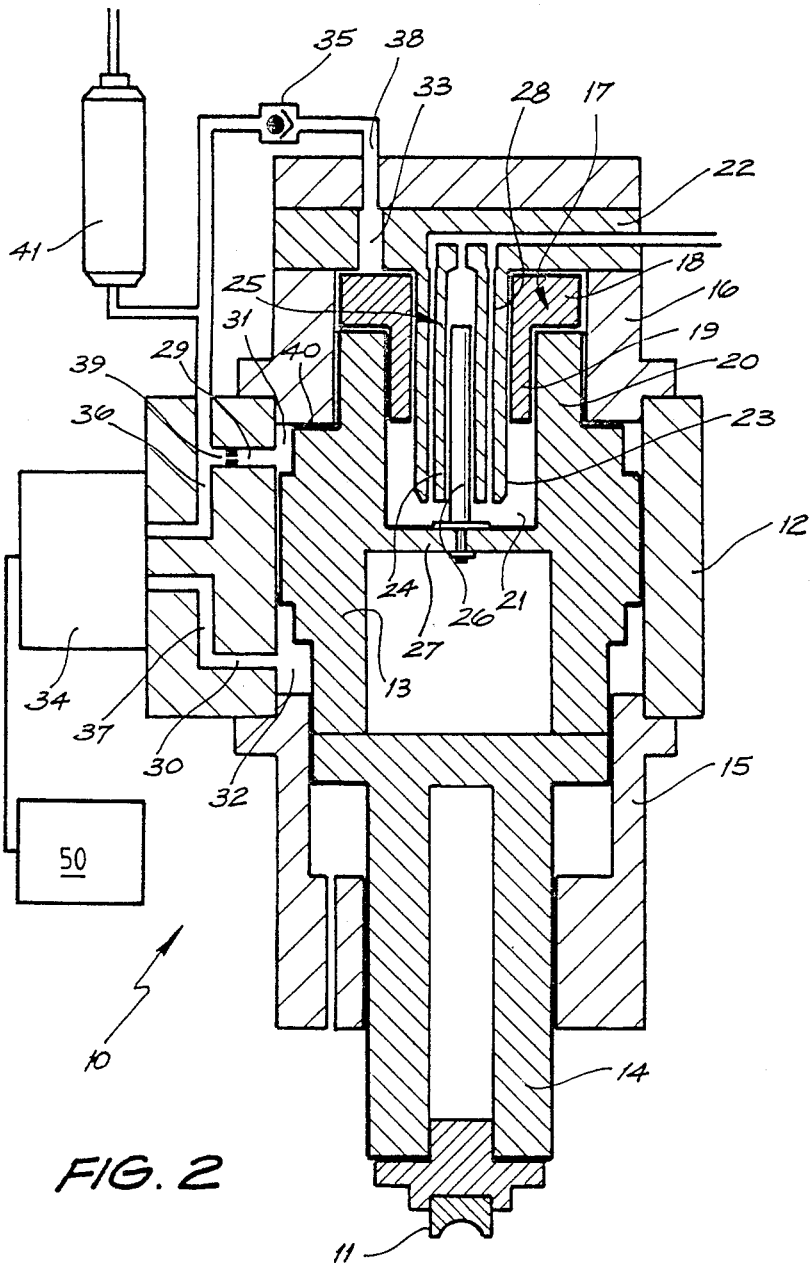
FIG. 2 is a sectional view illustrating the punching head assembly of the preferred embodiment in an inoperative attitude.

Referring to the drawings and to FIG. 2 in particular, there is illustrated a punching head assembly 10 according to a preferred embodiment of the present invention. The punching head assembly 10 is adapted to be mounted in a vertical attitude in a press, for example as shown in FIG. 1, and arranged to reciprocate a punching tool 11 so as to cause the tool to punch an aperture or apertures in a plate or sheet.

The punching head assembly 10 includes a first cylinder portion 12 which supports for reciprocation therein, a main punching piston 13 which is connected via a ram 14 to the punching tool 11 which may be of any suitable configuration to suit the shape and size of aperture to be punched. The cylinder 12 is closed at one end by an annular end cap 15 into which the piston 13 sealingly projects for connection to the ram 14 and is provided at its opposite end with an annular middle cap 16 having an internal diameter less than the internal diameter of the cylinder portion 12. Arranged for reciprocation within the middle cap 16 is a stepped auxilliary punching piston 17 which includes a first enlarged portion 18 in sliding engagement with the internal walls of the middle cap 16 and a forwardly projecting annular portion 19. As shown, the main piston 13 includes a rearwardly directed annular skirt-like portion 20 which is stepped inwardly from the main piston 13 and which is also slidably received within the middle cap 16. It will also be seen that the forwardly projecting portion 19 of the piston 17 extends into the volume 21 defined by the skirt portion 20.

The middle cap 16 is closed by a further end cap 22 which supports a tubular mounting 23 extending sealingly through the piston 17 and into the volume 21 defined by the skirt 20. The mounting 23 supports concentrically therein a fixed portion 24 of a linear variable displacement transducer 25 whilst the actuator 26 of the transducer 25 is supported on a radial web 27 of the main piston 13 and extends into the portion 24. An annular air space 28 is defined between the mounting 23 and fixed portion 24 of the transducer so as to communicate the volume 21 with atmosphere for a purpose hereunder described.

The cylinder 12 is provided with a pair of spaced ports 29 and 30 in its side wall whilst the piston 13 is provided with a pair of inwardly stepped portions adjacent the respective ports 29 and 30 to define extend and retract chambers 31 and 32 for the main piston 13. A further port 33 is provided in the end cap 22 and communicates with the end of the auxilliary piston 17.

Supply and exhaust of hydraulic fluid to and from the ports 29, 30 and 33 is controlled by a servo valve 34 and a pilot actuated check valve 35. As shown the servo valve 34 is disposed adjacent the ports 29 and 30 and is adapted to supply fluid thereto and exhaust fluid therefrom via respective passageways 36 and 37. The passageway 36 also communicates via the check valve 35 with a further passageway 38 which communicates with the port 33. Furthermore an orifice plug 39 is provided in the path of flow of fluid between the passageway 36 and port 29 so as to cause a pressure drop for a reason which will hereunder become apparent.

Figure 3:
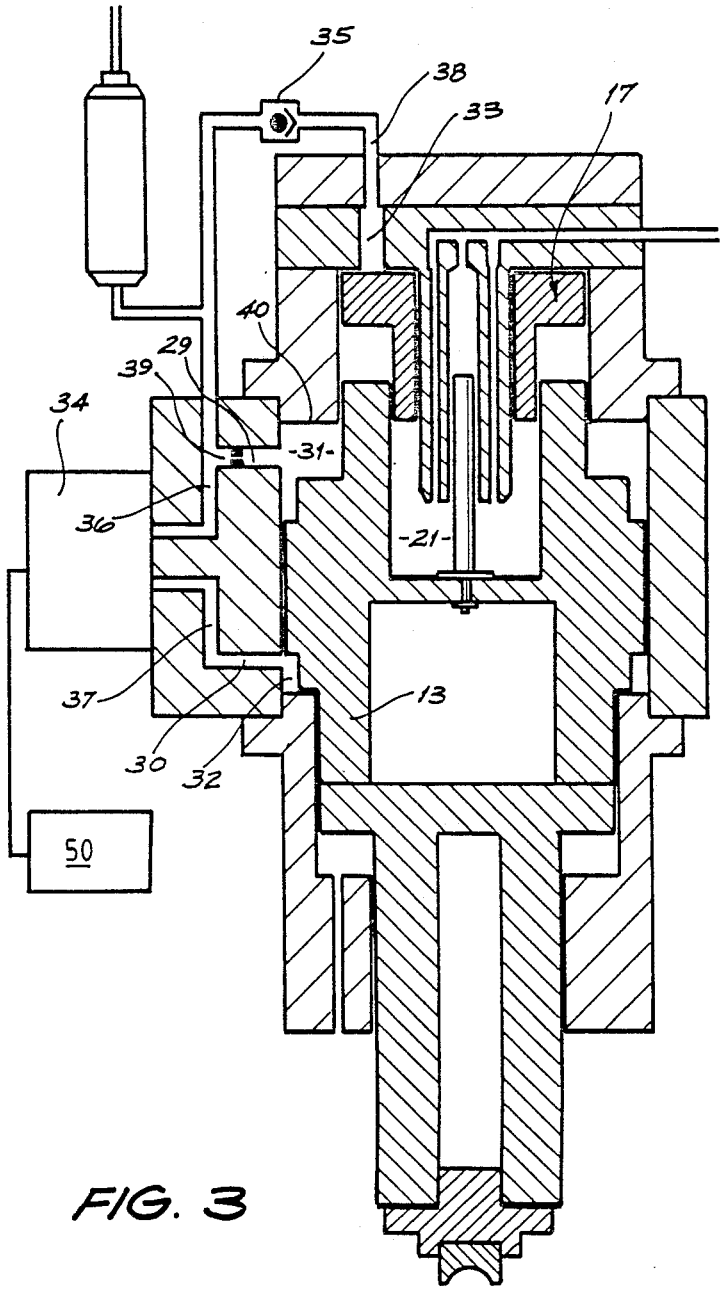
FIG. 3 is a sectional view illustrating the main piston of the punching head assembly in a first operative punching attitude for the punching of thinner materials.

In use and when it is desired to actuate only the main piston 13 for punching of relatively thin materials such as sheet metal, at a high rate, the servo valve 34 is actuated to supply pressurised hydraulic fluid to the passageway 36 and via the orifice plug 39 to the port 29 and into the chamber 31. At the same time pressurised fluid is communicated via passageway 36 to the check valve 35 but this valve will prevent flow of fluid into the passageway S8 and port SS. Actuation of the valve 34 also connects the port 30 and thus chamber 32 with exhaust. Pressurised fluid flowing into the chamber 31 will initially cause a small force to be applied to the piston 13 because of the relatively small annular area against which the fluid may act due to abutment of the stepped portion of the piston 13 adjacent the skirt 19 with the middle cap annular surface 40. However when the piston 13 lifts from the middle cap 16, a much greater area is exposed to the pressurised fluid (see FIG. 3) so that the main piston 13 may move rapidly forward to cause the punch to punch out the required aperture. At the same time the auxilliary piston 17 will be prevented from moving because the passageway 38 and port 33 are blocked by the valve 35 and movement of the piston would tend to create a vacuum. Furthermore venting of the volume 21 to atmosphere through the space 28 ensures that the piston 13 does not create a vacuum therein to cause movement of the piston 17. Preferably, the space 28 communicates with atmosphere via a filter so that debris is not drawn into the space 21 during the forward stroke of the piston 13. When it is desired to reverse movement of the piston 13, the passageway 36 is communicated with exhaust and hydraulic fluid fed to the passageway 37 and port 30 so that pressurised fluid fills the chamber 32 to cause retraction of the piston 13. In this mode of operation, the main piston 13 can move at a relatively high velocity but exert relatively low force due to the small area upon which the hydraulic fluid may act.

Figure 4:
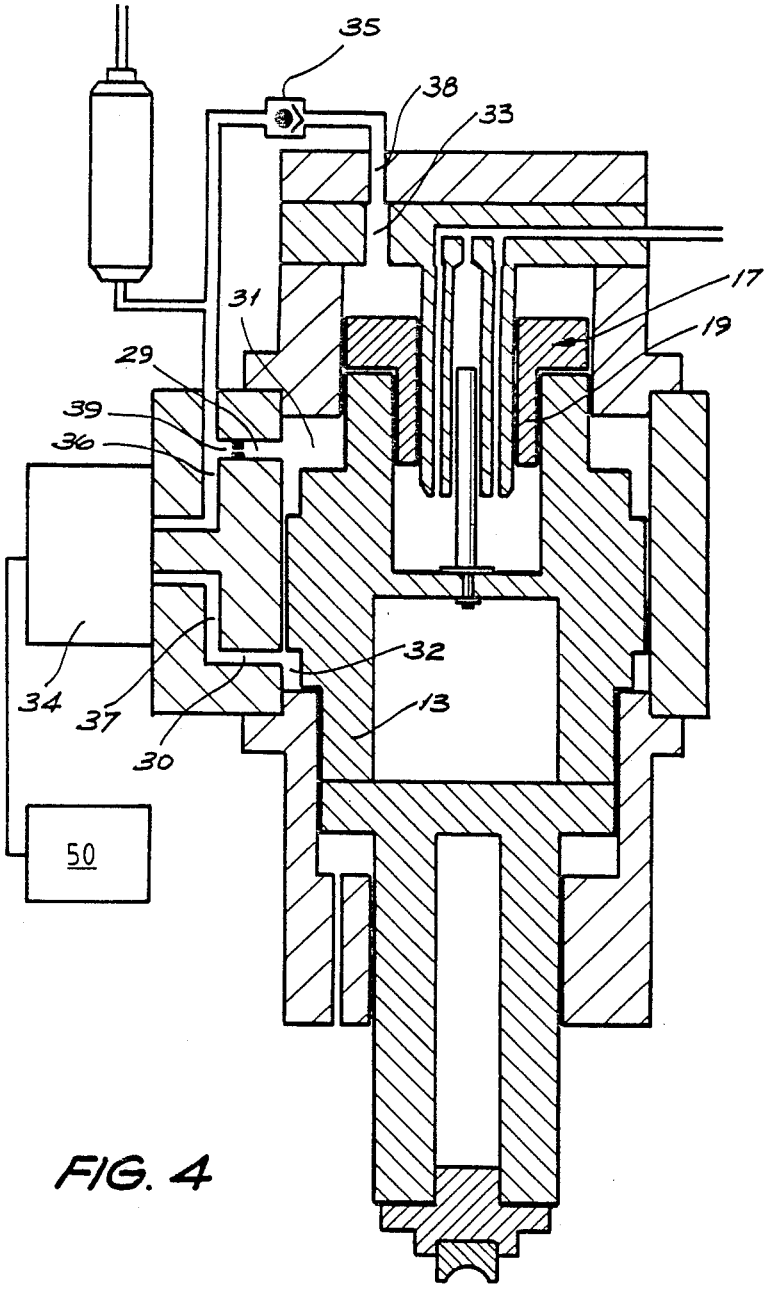
FIG. 4 is a sectional view illustrating the pistons of the punching head assembly in a second operative attitude for punching of thicker materials.

When it is desired to operate the punching head assembly 10 in a higher force but lower speed mode, shown in FIG. 4, the pilot operated check valve 35 is opened so that when pressurised fluid is applied to the passageway 36, the fluid will also pass through the check valve 35 into the passageway 38 and port 33 to act on the end of the piston 17. At the same time pressurised fluid is applied to the chamber 31 through the orifice plug 39 and port 29. Use of the orifice plug 39 ensures a greater pressure drop occurs between the passageway 36 and port 31 than between the passageway 36 and port 33 so that the main piston 13 will not commence to move before the auxilliary piston 17. This will then avoid any impacting force of the piston 17 upon the skirt portion 20 of the piston 13 and will maintain the pistons together. It will be seen that in this mode, the hydraulic fluid acts over a much greater area so that increased force is applied to the punch 11 for punching heavier materials such as metal plate.

When it is desired to retract both pistons 13 and 17 the passageway 36 is communicated with exhaust and pressurised fluid applied via the passageway 37 to the chamber 32 so that the retraction stroke of the piston 13 will also return the piston 17 to the position illustrated in FIG. 2.

So as to control operation of the machine a pressure transducer 41 communicates with the passageway 6 so that the pressure in the passageway can always be monitored during operation. Similarly the displacement transducer 25 provides continuous monitoring of the length of travel of the piston 13 and thus stroke of the punch 11. Use of a microprocessor 50 enables control of the pilot operated check valve 35 and servo valve 34 to optimise punching operation of the apparatus. During punching of plate, it is not normally necessary for the punch to completely penetrate the plate and enter the die to obtain break through. For example where the diameter of the punch is much greater than the material thickness, only some 20% penetration of the punch is required. Where break through occurs, a sudden pressure drop occurs due to rapid forward movement of the piston 13 and this may be detected by the pressure transducer 41. The microprocessor 50 when sensing such a pressure drop is operative to actuate the servo valve 34 to apply hydraulic fluid to the retract chamber 32 and exhaust the chamber 31 to cause the piston to reverse its stroke. This will thus minimise not only stroke of the piston 13 but will also enable an increased hit rate to be achieved and furthermore reduce noise levels generated by fully punching through the plate.

This operation can be further optimised through use of the linear variable displacement transducer 25. For example for each particular plate being punched, the microprocessor 50 can record the position/velocity/acceleration curve in its memory as detected by the linear variable displacement transducer 25 and pressure transducer 41. Use of a suitable algorithm allows these curves to be converted to plate properties (Young's modulus, modulus of rigidity, shear strength, strain, hardening rate etc.). In subsequent punches, this data can be used by the microprocessor 50 to control operation of the servo valve 34 and check valve 25 in order to minimise cycle time and noise. The microprocessor 50 can also be operative to control the punch so that it slows down towards the end of its stroke before it strikes the plate to minimise noise. Also, by reversing the punch as soon as the slug has "popped", a significant noise reduction is achieved.

Of course many other means may be employed to control the punch other than by a microprocessor. For example, hardware systems may be employed to control operation of the servo valve and cause return of the punching piston when a sudden pressure drop is sensed by the pressure transducer. Many other configurations of punching head assembly and dual pistons may also be employed to achieve the object of the present invention other than that described in the embodiment. Similarly fluid control to the punching assembly may be achieved by use of valves other than servo valves and check valves described above.

In some circumstances, the orifice plug 3g may be eliminated, although it is desirable that shock absorbing means be located between the piston 17 and skirt 20 to reduce impact forces.

The punching head assembly of the present invention is able to compensate for tooling offset due to wear of the punching tool 11. Using feedback from the displacement transducer 25, the microprocessor controlled servo valve 34 is able to adjust the stroke of the piston 13 to compensate for any such tooling offset.

Figure 5:
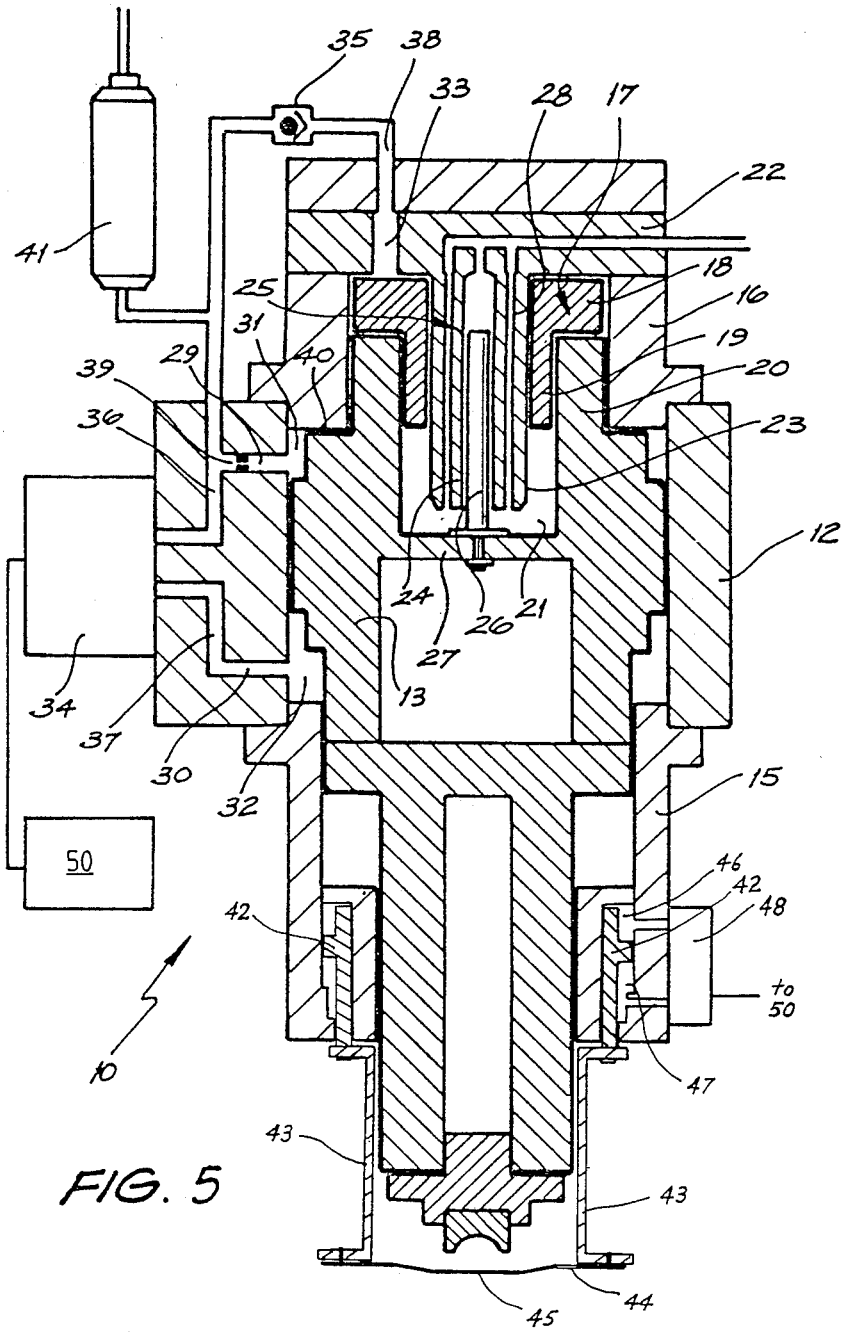
FIG. 5 is a sectional view illustrating the punching head assembly of FIG. 2 with a stripper assembly.

A stripper assembly can also be used with the present invention as illustrated in FIG. 5. After the metal sheet is punched by the punching tool, it tends to stick to the punching tool as it is removed. A stripper assembly is used to facilitate the removal of the punching tool by holding down the metal sheet. As shown in FIG. 5, the stripper assembly comprises a stripper plate 44 having a depressed centre portion with an aperture 45 through which the punching tool 11 projects to punch the metal sheet. The stripper plate 44 is clamped to a cylindrical sleeve 43 which may have an opening therein to give access to the punching tool 11. The sleeve 43 in turn is connected to an annular piston 40 which is sealingly received in an annular cylinder and adapted for vertical reciprocal movement therein. A circumferential rib on the annular piston 42 divides the cylinder into extend and retract chambers 46, 47 respectively. These chambers are respectively connected to associated servo valves 48. By alternating the flow through the extend and retract chambers 46, 47, the piston 42 can be moved up and down, thereby moving the stripper plate 44 in a corresponding up and down fashion.

Although the stripper assembly has its own hydraulic operating system, it is controlled in conjunction with the hydraulic system of the punching assembly by the microprocessor 50.

In use, the stripper plate 44 is clamped down on the punched sheet to facilitate the removal of the punching tool after punching. Since the punching assembly is hydraulically operated, its position can be adjusted easily. The stripping plate 44 can be retracted from the sheet to allow forming operations and to cater for angled sheets or other deviations from a planar sheet.

In a first mode of operation, the punching assembly is operated in con unction with the punching tool so that the stripper plate 44 hits the work sheet just before the punch. In other words, the punch slightly trails the stripper plate 44 on the down stroke. This can be achieved by adjusting the controllable flow rate of the main piston 13 and/or auxilliary piston 17 by the servo valves.

The clamping pressure which the stripping plate 44 exerts on the work sheet can be adjusted by suitable control of the servo valves. For example, to ensure that thin sheet is not dented by the stripper plate, only a relatively light clamping pressure is applied. On the other hand, where a thick plate is being punched, a higher stripping force is required for stripping the punching tool from the plate so a higher clamping force is applied.

In a second mode of operation, the stripper plate 44 is positioned slightly above the work sheet. When the punching tool is removed from the work sheet, it initially brings the sheet up with it, until it abuts against the stripper plate. The work sheet then attempts to force the stripper plate upwards, but as the hydraulic fluid cannot be compressed, the work sheet will be prevented from any further upward movement and the punching tool will thereby be stripped from the work sheet. It will be apparent to those skilled in the art that the stripper plate applies only just enough force to the work sheet to achieve stripping of the punching tool.

The stripper assembly can also be operated in conjunction with the punching assembly to measure the thickness of the work sheet. Before the measurement is taken, both the main piston 13 and the annular piston 42 are fully retracted. Pressurised hydraulic fluid is then pumped into the respective extend chambers of the main piston 13 and the annular piston 42. A pressure switch (not shown) is connected to the extend chamber cf the annular piston and is responsive to abrupt increases in pressure. When the stripper plate 44 hits the die surface, the pressure switch will detect an abrupt increase in pressure in the extend chamber of the annular piston. This output signal is fed back to the microprocessor controller which determines the distance which the linear distance transducer 25 has moved. This information is stored in the machine set-up data. Thereafter when a plate is inserted between the stripper and die, by comparing the distance which the stripper plate 44 has moved in contacting the surface of the work sheet, the thickness of the work sheet can thus be obtained by subtraction.

While the above has been given by way of illustrative example, such modifications and variations as would be apparent to persons skilled in the art may be made thereto without departing from the broad scope and gambit of the invention as defined in the following claims.

I claim:

1. A punching head assembly for a punch press, said punching head assembly comprising a cylinder portion having a first piston member adapted for reciprocating movement therein, said first piston member having a pair of radial work surfaces each defining part of a respective one of a first extend chamber and a retract chamber; control means, said first extend chamber and said retract chamber being in respective fluid communication with said control means adapted to alternate a flow of pressurized fluid to said chamber to obtain reciprocating movement of the piston member, said control means comprising valve means controlled by a microprocessor; a second piston member juxtaposed axially with said first piston member and having a radial work surface defining part of a second extend chamber which is in controlled fluid communication with said control means, whereby the flow of pressurized fluid to said second extend chamber is selectively opened to drive said first and second piston members together and closed to disable said second piston member, said first piston member being connected to a ram having a punching tool at an operative end thereof; and a stripper assembly having a stripper plate at least partially surrounding said punching tool, a hydraulic piston adapted for reciprocating movement axially relative to said ram and being connected to said stripper plate, and valve means operated by said microprocessor for controlling axial movement of said hydraulic piston and said stripper plate independently of said punching tool.

2. A punching head assembly as claimed in claim 1, wherein said punching tool and said stripper plate have contemporaneous downward strokes, the punching tool and the stripper plate being controlled such that said punching tool lags slightly behind said stripper plate so that said stripper plate abuts and clamps a work sheet momentarily prior to punching.

3. A punching head assembly for a punch press, said punching head assembly comprising a cylinder portion having a first piston member adapted for reciprocating movement therein, said first piston member having a pair of radial work surfaces each defining part of a respective one of a first extend chamber and a retract chamber, control means, said first extend chamber and said retract chamber being in respective fluid communication with said control means adapted to alternate a flow of pressurized fluid to said chambers to obtain reciprocating movement of the first piston member, said control means comprising valve means controlled by a microprocessor; a second piston member juxtaposed axially with said first piston member and having a radial work surface defining part of a second extend chamber which is in controlled fluid communication with said control means, whereby the flow of pressurized fluid to said second extend chamber is selectively opened to drive said first and second piston members together and closed to disable said second piston member, wherein said first and second extend chambers have respective fluid communication paths connected to a common fluid communication path from said control means, and pressure reduction means provided in the fluid communication path between said common path and the first extend chamber.

4. A punching head assembly as claimed in claim 3, wherein said first piston member comprises a second pair of radial surfaces adapted to abut against respective axial abutments of the cylinder portion which define the end of travel for said first piston member in opposite directions, each of said second pair of radial surfaces forming part of an enlarged respective one of the first extend chamber and the retract chamber when another radial surface abuts its associated abutment.

5. A punching head assembly as claimed in claim 3, further comprising a pressure transducer having an input communicating with the common fluid communication path and an output connected to the microprocessor.

6. A punching head assembly as claimed in claim 5, wherein said microprocessor is responsive to abrupt pressure drops detected by said pressure transducer during a punching stroke to actuate said valve means to cause reversal of the piston stroke.

7. A punching head assembly as claimed in claim 3, further comprising a displacement transducer whose output is connected to the microprocessor, said displacement transducer comprising a first elongate member connected to the first piston member and slidably received within a sleeve member whose position is fixed in relation to said cylinder portion, the output of said displacement transducer being determined by the position of said elongate member relative to said sleeve member.

8. A punching head assembly as claimed in claim 3, wherein said first piston member has a cylindrical skirt portion, and said second piston member has a reduced diameter portion slidably received within said skirt portion and defining part of a variable chamber within said skirt portion, said variable chamber being vented to the atmosphere.

9. A punching head assembly as claimed in claim 8, wherein said first piston member is connected to a ram having a punching tool at an operative end thereof.

10. A punching head assembly as claimed in claim 3, wherein said microprocessor is responsive to the output of said displacement transducer to decelerate the first piston member towards the end of its punching stroke.

11. A punching head assembly as claimed in claim 3, wherein the radial work surface of the second extend chamber is greater than the radial work surface of the first extend chamber.

12. A punching head assembly as claimed in claim 11, wherein the radial work surfaces of said first extend chamber and said retract chamber are annular.

* * * * *